US009980615B1

(12) United States Patent
Maercovich

(10) Patent No.: US 9,980,615 B1
(45) Date of Patent: May 29, 2018

(54) AUTOMATIC FOAM SOAP DISPENSER

(71) Applicant: Jorge Maercovich, Chatsworth, CA (US)

(72) Inventor: Jorge Maercovich, Chatsworth, CA (US)

( * ) Notice: Subject to any disclaimer, the term of this patent is extended or adjusted under 35 U.S.C. 154(b) by 0 days. days.

(21) Appl. No.: 15/650,963

(22) Filed: Jul. 16, 2017

(51) Int. Cl.
*A47K 5/14* (2006.01)
*A47K 5/12* (2006.01)
*A47K 5/00* (2006.01)

(52) U.S. Cl.
CPC ..... *A47K 5/1205* (2013.01); *A47K 5/1211* (2013.01); *A47K 5/1217* (2013.01); *A47K 5/14* (2013.01); *A47K 5/00* (2013.01)

(58) Field of Classification Search
CPC ..... A47K 5/12; A47K 5/1202; A47K 5/1208; A47K 5/1217; A47K 5/1205; A47K 5/1211; A47K 5/00; A47K 2005/1218; A47K 5/14
See application file for complete search history.

(56) References Cited

U.S. PATENT DOCUMENTS 3,419,188 A * 12/1968 Matchett ..... A47K 5/1217 222/52
4,938,384 A * 7/1990 Pilolla ..... A47K 5/1205 222/333
4,957,218 A * 9/1990 Ford, Jr. ..... B05B 7/0037 222/1
9,603,494 B1 * 3/2017 Wang ..... A47K 5/14
2011/0215115 A1 * 9/2011 Proper ..... B67D 7/76 222/173
2013/0032614 A1 * 2/2013 Babikian ..... B01F 5/0693 222/190
2013/0270300 A1 * 10/2013 Ciavarella ..... A47K 5/1205 222/190
2014/0076924 A1 * 3/2014 Liang ..... A47K 5/16 222/52
2015/0102067 A1 * 4/2015 Ciavarella ..... B05B 7/0037 222/190
2015/0223646 A1 * 8/2015 Wegelin ..... A47K 5/1217 222/1
2015/0313421 A1 * 11/2015 Wang ..... A47K 5/16 222/52

(Continued)

*Primary Examiner* — Patrick M Buechner
(74) *Attorney, Agent, or Firm* — Raymond Y. Chan; David and Raymond Patent Firm

(57) ABSTRACT

An automatic foam soap dispenser, for dispensing a liquid soap contained in a liquid reservoir in form of foam soap, includes a mixing passage, a liquid soap dispenser, an air dispenser, and an outlet nozzle. The liquid soap dispenser has a liquid soap pump communicated with the mixing passage to upwardly pump the liquid soap to the mixing passage, and a first power source associated with the liquid soap pump and used for driving the liquid soap pump, wherein the liquid reservoir is operatively coupled with the liquid soap pump and located below the liquid soap pump to store the liquid soap. The air dispenser has an air pump communicated with the mixing passage to synchronically and upwardly pump the atmosphere air to the mixing passage, and a second power source associated with the air pump and used for driving the air pump. The outlet nozzle is connected with the mixing passage and having at least a foam maker adapted for generating the foam soap.

13 Claims, 5 Drawing Sheets

(56) References Cited

U.S. PATENT DOCUMENTS

| | | | | |
|---|---|---|---|---|
| 2015/0327730 | A1* | 11/2015 | McNulty | A47K 5/14 222/1 |
| 2016/0263604 | A1* | 9/2016 | Ramdhiansing | B05B 11/3087 |
| 2017/0135531 | A1* | 5/2017 | Mak | A47K 5/14 |

* cited by examiner

AUTOMATIC FOAM SOAP DISPENSER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to the field of the field of soap dispensers, and more particularly to the field of automated soap dispensers.

Description of Related Arts

To improve the cleanliness within public restrooms as much as possible, an automated solution is provided to handwashing at the sink area. To enable one to wash hands at the sink area with a hand-free operation faucet system is relatively utilized because the hand wash apparatus, such as faucet and soap dispenser, are the last things we touch in a restroom. One of the most recent developments in this area is the automated hand soap dispenser. Equipping with a sensor, the automated hand soap dispenser is able to sense when a hand is placed underneath the dispenser and then a predetermined amount of the hand soap is automatically dispensed. The main objective of this dispenser is not only to prevent the spread of bacteria through initiating less apparatus contact, but also to control to dispense the predetermined amount of soap to conserve the usage.

Additionally, the use of foam soap has been recently and widely adopted by many public restrooms. The advantage of foam soap is that, since liquid soap requires to mix with water to produce a mass of bubbles for handing cleaning purpose, more than enough amount of liquid soap is dispensed and a certain amount of liquid soap will be waste generally. However, the foam soap is produced by mixing less liquid soap with air while providing better cleaning ability. Also, since the foam soap is dispensed pre-lathered, the user is able to spend less time attempting to achieve this same amount of lather as with a thick liquid soap.

Current automated foam soap dispensers achieve the above objective as well as its disadvantages. Conventional automated foam soap dispenser requires a motorized actuation to depress the nozzle to dispense the foam soap and requires additional mechanical work installed under the sink area to pump the soap up and mixed with air through a tube. It is because the soap dispenser contains a nozzle that is set perpendicular to a central axis of the dispenser container. This requires a design for the conventional automated foam soap dispenser to include a large cumbersome motor to fulfill such task. Such large motor is very aesthetically unpleasing and force the automated foam soap dispenser to be mounted underneath the sink area of a restroom.

SUMMARY OF THE PRESENT INVENTION

The invention is advantageous in that it provides an improved automatic foam soap dispenser which is more compact in size and simpler in structure.

Another advantage of the invention is to provide an inline push bottom system adapted to actuate the pump nozzle of the foam soap dispenser.

Another advantage of the invention is to provide an inline push button system adapted to return the pump nozzle of the foam soap dispenser to its original position.

Another advantage of the invention is to provide methods of mounting the automatic foam soap dispenser in more compact arrangement, with respect to the prior art.

Another advantage of the invention is to provide an inline dispenser nozzle for the automatic foam soap dispenser that eliminates the requirement of the additional motor to pump the foam soap to the operator of the conventional art.

Another advantage of the invention is to provide an inline push button system that is able to transmit the rotational movement of a motor to linear movement to actuate a link to pump the dispenser nozzle of the automatic foam soap dispenser and return it to its original position in a single process.

Additional advantages and features of the invention will become apparent from the description which follows, and may be realized by means of the instrumentalities and combinations particularly point out in the appended claims.

According to the present invention, the foregoing and other objects and advantages are attained by an automatic foam soap dispenser.

In accordance with one aspect of the invention, the present invention provides a foam soap dispenser which comprises a liquid reservoir, an output nozzle, an inlet tube, a liquid-to-foam soap system, a mounting arrangement, a corresponding mounting arrangement, a motorized push button system, a transmission system for transmitting the rotational motion of a motor into a reciprocating linear movement, a sensor, a tubing arrangement to dispense the foam soap, a power supply, and a housing.

The present invention of an automatic foam soap dispenser improves upon the conventional art by utilizing a motorized inline push button system to actuate a single reciprocating linear movement to pump an inline dispenser nozzle for a foam soap dispenser and to drive it to return to its position. Since the dispenser nozzle is arranged inline with the direction of the fluid flow, no additional motor is required to pump the foam soap to the user.

In accordance with another aspect of the invention, the present invention provides an automatic foam soap dispenser which comprises:

a mixing passage to store the atmosphere air and a liquid soap;

a liquid soap dispenser having a liquid soap pump communicated with the mixing passage to upwardly pump the liquid soap to the mixing passage, and a liquid soap motor associated with the liquid soap pump and used for driving the liquid soap pump;

an air dispenser having an air pump communicated with the mixing passage to synchronically and upwardly pump the atmosphere air to the mixing passage, and an air motor associated with the air pump and used for driving the air pump;

an outlet nozzle connected with the mixing passage and having a plurality of filter for generating the foam soap; and a liquid reservoir operatively coupled with the liquid soap pump and located below the liquid soap pump to store the liquid soap.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
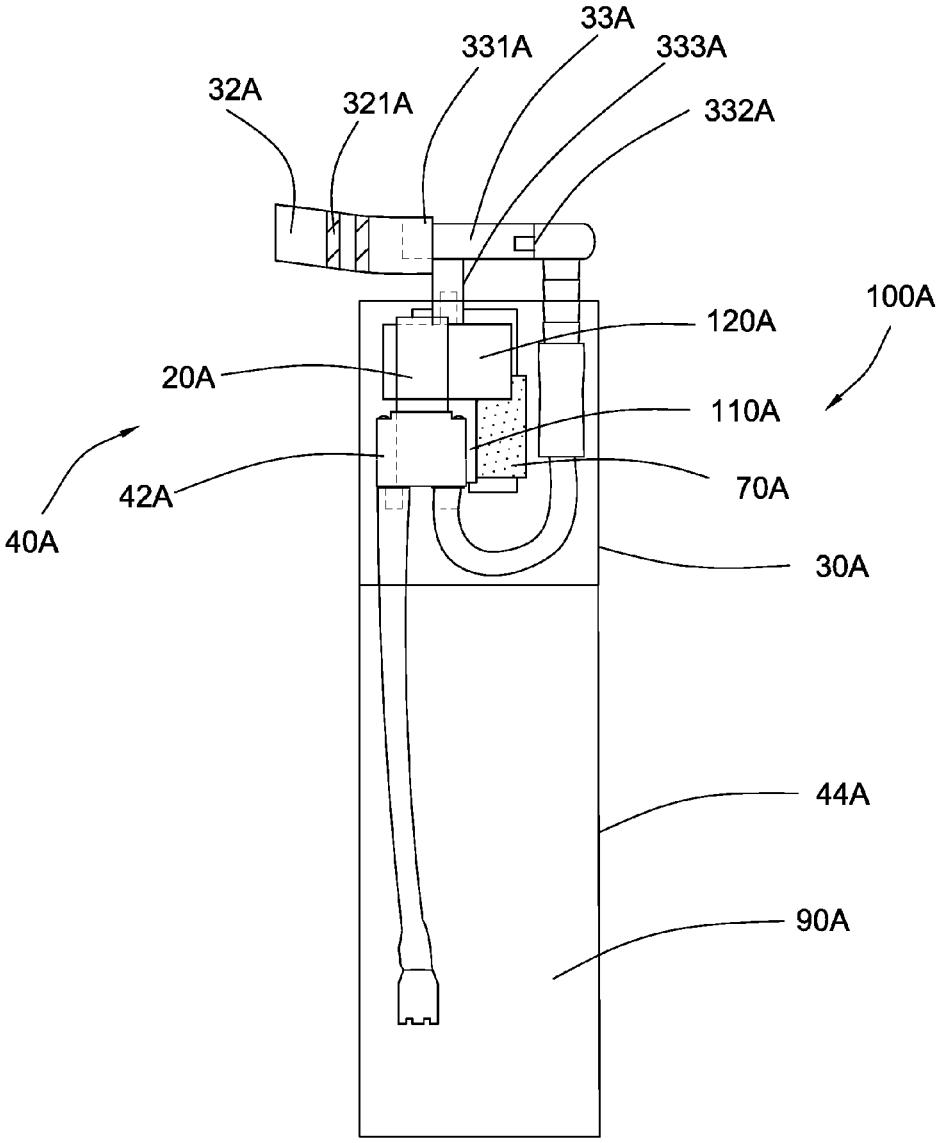
FIG. 1 is a schematic view of an automatic foam soap dispenser according to a first preferred embodiment of the present invention.

FIG. 1 illustrates an automatic foam soap dispenser according to a first preferred embodiment of the present invention, wherein the automatic foam soap dispenser comprises a housing 30A, an outlet nozzle 32A having a foam maker 321A, such as a net filter, for dispensing the liquid soap 90A in form of foam, a mixing passage 33A having an outlet end 331A communicated with the outlet nozzle 32A to mix the atmosphere air and the liquid soap 90A to form soap with air, a liquid soap inlet 332A, and an air inlet 333A, wherein the atmosphere air and the liquid soap 90A in the mixing passage 33A are passed through the foam maker 321A to generate the foam soap for being dispensing out of the outlet nozzle 32A.

Figure 2:
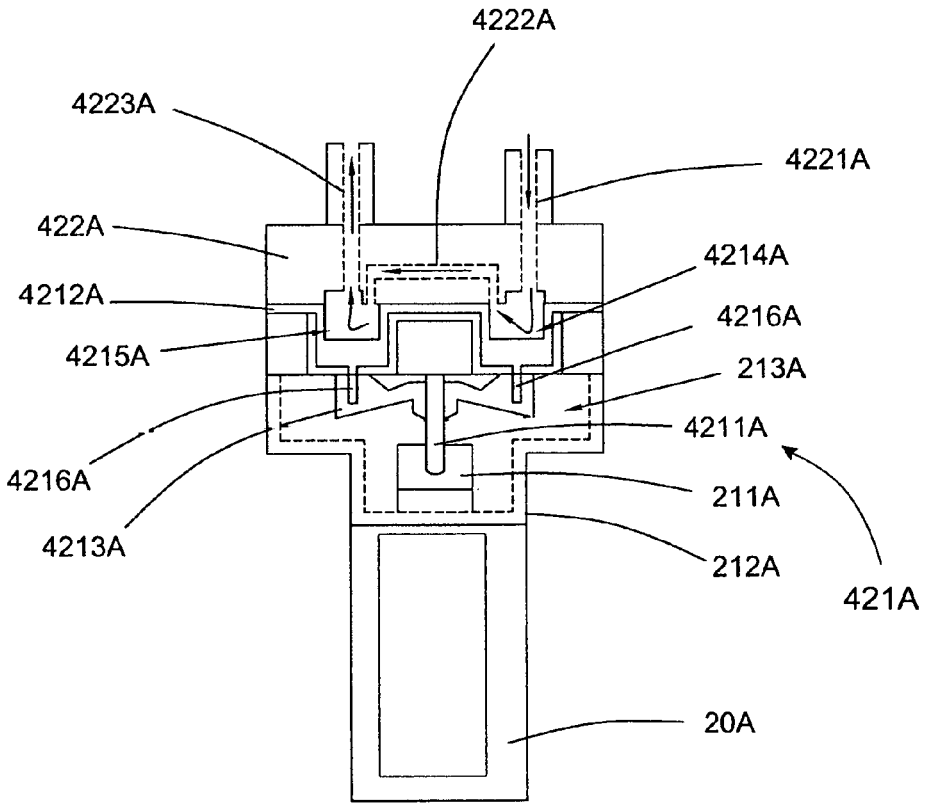
FIG. 2 is a schematic view of a liquid soap pump of the automatic foam soap dispenser according to the above first preferred embodiment of the present invention.

Referring to FIG. 1 and FIG. 2 of the drawings, the automatic foam soap dispenser further comprises a liquid soap dispenser 40A, an air dispenser 100A, and a liquid reservoir 44A located below the liquid soap dispenser 40A and the air dispenser 100A, wherein the liquid soap dispenser 40A comprises a liquid soap pump 42A configured as a diaphragm pump, and a liquid soap motor 20A having a first motor extending portion 211A electrically connected with the liquid soap pump 42A.

The liquid soap pump 42A comprises a first upper base 421A comprising a first transmission shaft 4211A having one end operatively linked with the first motor extending portion 211A, and a first diaphragm 4212A having one side operatively linked with the other end of the first transmission shaft 4211A through a first diaphragm actuator 4213A and an opposite side of the first diaphragm 4212A having two press chambers, a first press chamber 4214A and a second press chamber 4215A.

The liquid soap pump 42A further comprises a first lower base 422A having a liquid pump inlet 4221A communicated with the first press chamber 4214A, a liquid pump outlet 4223A communicated with the second press chamber 4215A and the liquid soap inlet 332A of the mixing passage 33A, and a liquid transmission channel 4222A communicated with the first and the second press chamber 4124A, 4215A. The liquid pump inlet 4221A is operatively associated with the liquid reservoir 44A for providing liquid soap 90A into the liquid soap pump 42A, and then the liquid soap 90A is delivered to liquid soap inlet 332A to the liquid pump outlet 4223A, passed by the liquid transmission channel 4222A, by the function of the liquid soap pump 42A.

Accordingly, the first transmission shaft 4211A is driven by the liquid soap motor 20A to provide reciprocating forces to the first diaphragm 4212A, and then the first diaphragm 4212A is activated to do a reciprocating motion in combination of the first lower base 422A to pump the liquid soap 90A from the liquid reservoir 44A. When a volume of the first press chamber 4214A is increased (while the first diaphragm 4212A is moving up), the pressure thereof decreases, and the liquid soap 90A is drawn from the liquid pump inlet 4221A to the first press chamber 4214A. When the pressure of the first press chamber 4214A later increases from the decreased volume (while the first diaphragm 4212A is moving down), the liquid soap 90A is forced out to the second press chamber 4215A through the liquid transmission channel 4222A. In other words, after the liquid soap 90A is delivered to the second press chamber 4215A, the liquid soap 90A is forced out of the liquid pump outlet 4223A to the liquid soap inlet 332A of the mixing passage 33A by the reciprocating motion. Therefore, the liquid soap 90A is upwardly delivered from the liquid reservoir 44A to the mixing passage 33A by the liquid soap dispenser 40A to overcome the gravity of the liquid soap 90A.

It is worth mentioning that the liquid soap motor 20A further comprises a first motor base 212A defined as a first receiving cavity 213A, wherein since the reciprocating motion of the first diaphragm 4212A is an up-and-down motion, the reciprocating motion of the first diaphragm 4212A is operated inside the first receiving cavity 213A. In other words, the first transmission shaft 4211A, upper parts of the first diaphragm 4216A, and the first diaphragm actuator 4213A are disposed within the first receiving cavity 213A of the first motor base 212A.

Figure 3:
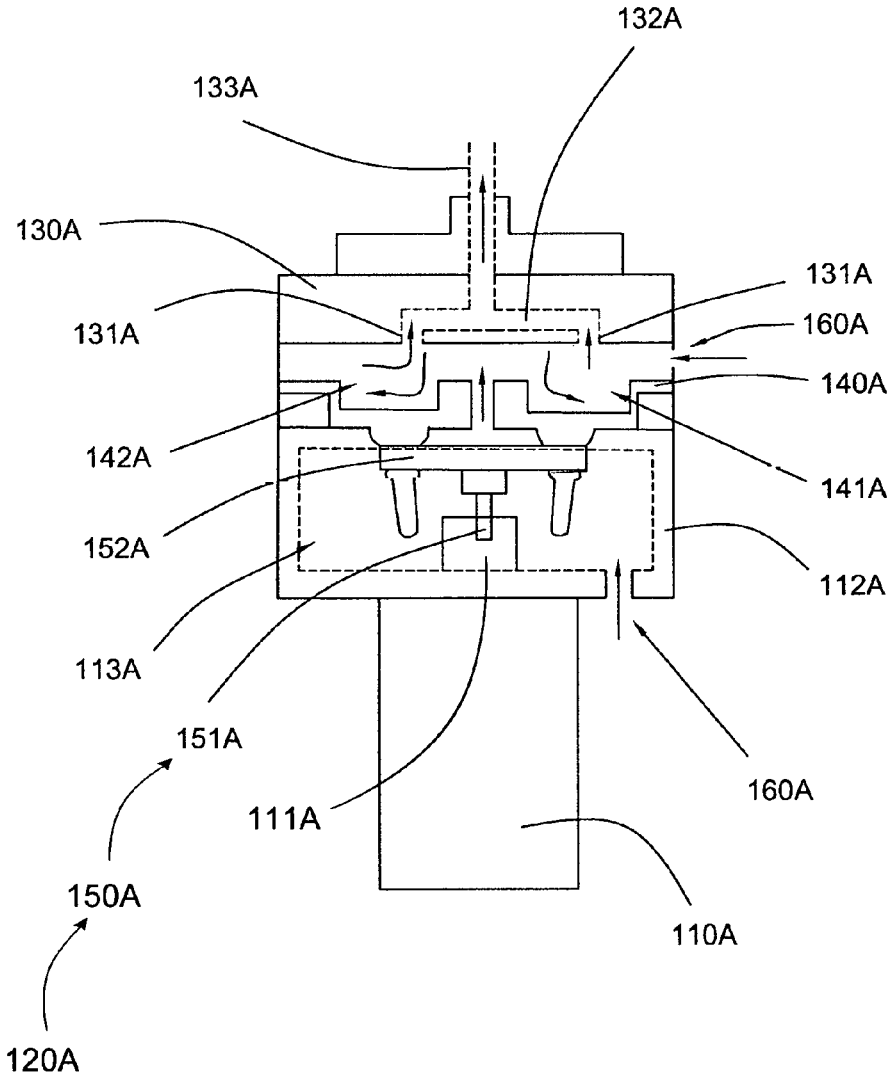
FIG. 3 is a schematic view of an air pump of the automatic foam soap dispenser according to the above first preferred embodiment of the present invention.

Referring to FIG. 3 of the drawings, the air dispenser 100A further comprises an air pump 120A, configured as a diaphragm pump, and an air motor 110A having a second motor extending portion 111A electrically connected with the air pump 120A and a second motor base 112A defined a second receiving cavity 113A.

The air pump 120A comprises a second lower base 150A having a second transmission shaft 151A operatively linked with the second motor extending portion 111A, and a second diaphragm 140A having one side operatively linked with the second transmission shaft 151A through a second diaphragm actuator 152A and an opposite side having two press chambers, a third press chamber 141A and a fourth press chamber 142A.

The air pump 120A further comprises a second upper base 130A having at least one air pump inlets 131A communicated with the third and fourth press chamber 141A, 142A, an air pump outlet 133A communicated with the air inlet 333A of the mixing passage 33A, and a second air transmission channel 132A communicated with the air pump inlet 131A to deliver the atmosphere air to the air pump outlet 133A.

Accordingly, the second transmission shaft 151A is driven by the air motor 110A to provide reciprocating forces to the second diaphragm 140A, and then the second diaphragm 140A is activated to do a reciprocating motion in combination of the second lower base 150A to pump the atmosphere air in the third and fourth press chamber 141A, 142A. It is worth mentioning that the air dispenser further comprises an air passage 160A formed through the second motor base 112A, the second receiving cavity 113A, the second lower base 150A, and the second diaphragm 140A, wherein air is capable of delivering from outside to the third and fourth chamber 141A and 142A through the air passage 160A. Alternatively, the air passage 160A is arranged on the second lower base 150A and communicated with the third and fourth chambers 141A and 142A, so the atmosphere air can directly enter the third and fourth chambers 141A and 142A through the air passage 160A.

When a volume of the third press chamber 141A is increased (while the second diaphragm 140A is moving up), the pressure thereof decreases, and the atmosphere air is drawn from the air passage 160A to the third and fourth press chamber 141A, 142A. When the pressure of the third and fourth press chamber 141A, 142A later increases from the decreased volume (while the second diaphragm 140A is moving down), the atmosphere air in the third and fourth chamber 141A, 142A is forced out of the air pump inlet 131A through the air transmission channel 132A to the air pump outlet 133A. In other words, the atmosphere air is forced out of the air pump outlet 133A to the air inlet 333A of the mixing passage 33A by the reciprocating motion.

It is worth mentioning that the air motor 110A and the liquid soap motor 20A are powered by a power source 70A which can be embodied as a battery or a power supply assembly having appropriate voltage, such as a plug electrically connected with a wall socket. In other words, the air motor 110A and the liquid soap motor 20A are electrically connected with together, and that only one power source 70A is required to power the air motor 110A and the liquid soap motor 20A.

Figure 4:
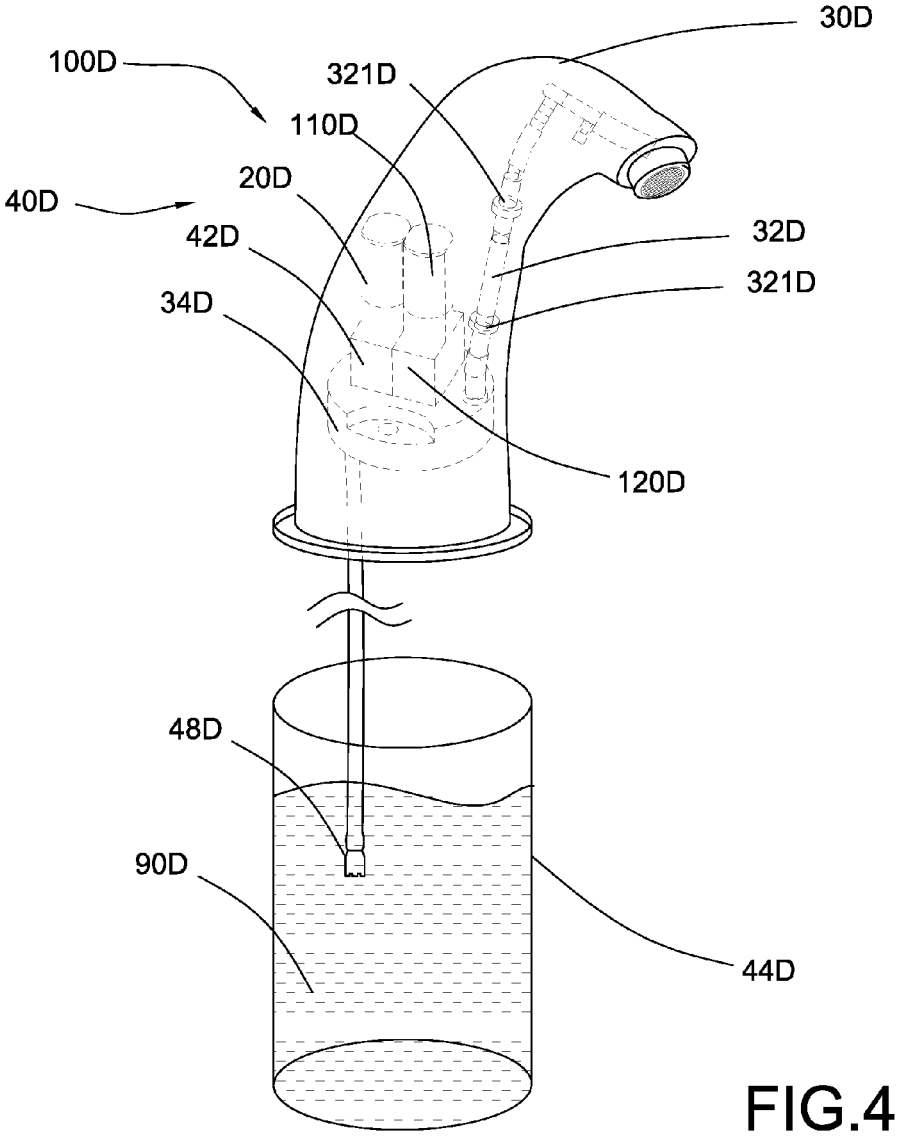
FIG. 4 is a schematic view of an automatic foam soap dispenser according to a second preferred embodiment of the present invention.

Referring to FIG. 4 of the drawings, an automatic foam soap dispenser according to a second preferred embodiment of the present invention is illustrated, wherein the automatic foam soap dispenser comprises a liquid soap dispenser 40D, an air dispenser 100D, a liquid reservoir 44D located below the liquid soap dispenser 40D and the air dispenser 100D to store the liquid soap 90D, a processing unit 34D communicably associated with the liquid soap dispenser 40D and the air dispenser 100D to mix the atmosphere air and the liquid soap 90D to form soap with air, and an outlet nozzle 32D having a foam maker 321D, such as a net filter, for dispensing the liquid soap 90D in form of foam. Accordingly, the structure of the liquid soap dispenser 40D and the air dispenser 100D may respectively have the same structure as the liquid soap dispenser 40A and the air dispenser 100D in the above mentioned second preferred embodiment.

The air dispenser 100D comprises an air pump 120D, a liquid soap pump 42D, a first power source 110D associated with the liquid soap pump 42D and used for driving the liquid soap pump 42D, a power source associated with the air pump 120D and used for driving the air pump, and a processing unit 34D communicably associated with the air pump 120D and the liquid soap pump 42D. Preferably, the liquid soap pump 41D is arranged underneath the liquid soap motor 20D, and the air pump 120D is arranged underneath of the air motor 110D, so that the air pump 120D and the liquid soap pump 41D are communicated with the processing unit 34D.

It is worth mentioning that the configuration between the liquid soap dispenser 40D, the air dispenser 100D, and the processing unit 34D is a space-saving configuration, wherein the liquid soap 90D and the atmosphere air are pre-mixed inside the liquid and air mixing passage 33D, and in other words, all the passages not only provided to transport the liquid soap 90D, but also to inject the atmosphere air for mixing with the liquid soap 90D are deposited inside the processing unit 34D. Therefore, all of passages are stored inside the processing unit 34D without exposing. In addition, the liquid soap motor 20D and the liquid soap pump 42D are vertically stacked on the processing unit 34D one-by-one. Also, the air motor 110D and the air pump 120D are vertically stacked on the processing unit 34D one-by-one.

The configuration between the processing unit 34D and either the liquid soap dispenser 40D or the air dispenser 100D, are vertically expanded, and the automatic foam soap dispenser can be stored into an elongated receptacle, embodied as a soup dispensing spout 30D, wherein the soup dispensing spout 30D can be mounted on a counter top or beside the sink to facilitate the user for using the foam-type soap to clean their hands. Alternatively, the soup dispensing spout 30D can be detachably coupled on the reservoir 44D, which is embodied as a portable bottle for storing the liquid soap 90D.

Figure 5:
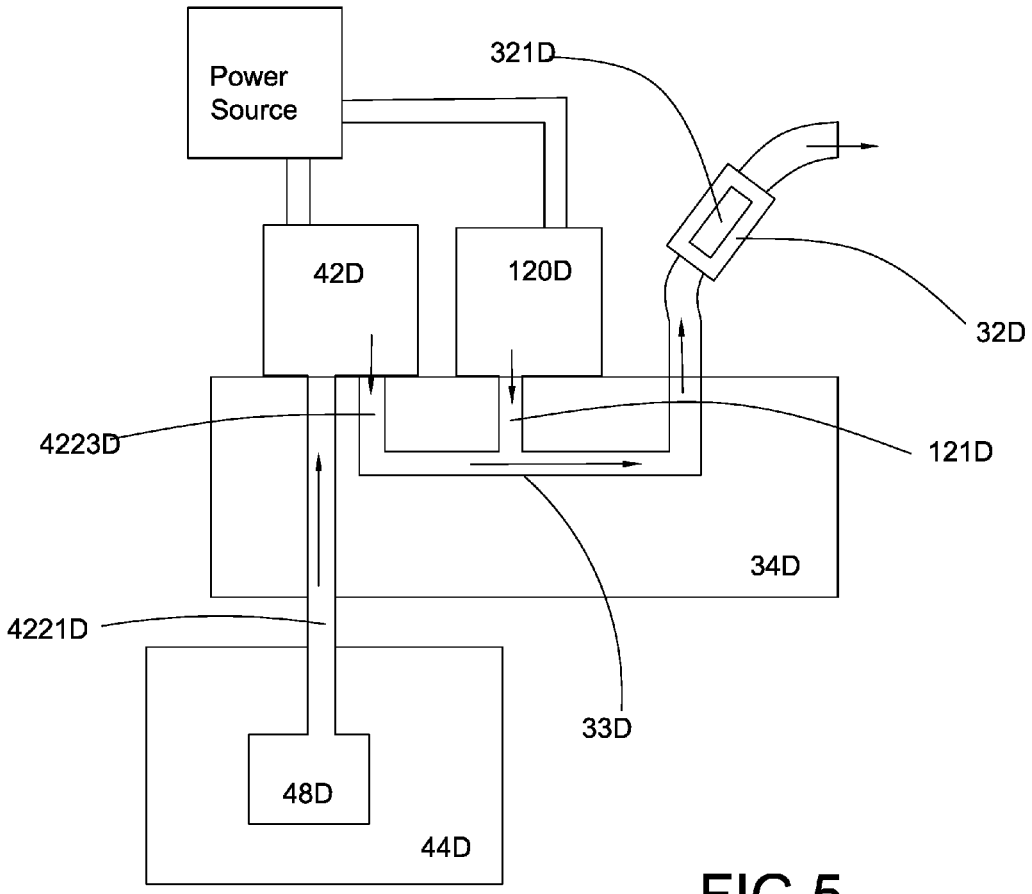
FIG. 5 is a schematic view illustrating the system for an automatic foam soap dispenser according to the above second preferred embodiment of the present invention.

Referring to FIG. 5 of the drawings, the processing unit 34D comprises an air outlet passage 121D communicated with the air pump 1200D to deliver air into the processing unit 34D, a liquid inlet passage 4221D communicated with the liquid reservoir 44D through a check valve 48D, a liquid outlet passage 4223D communicated with the liquid soap pump 42D to deliver the liquid soap 90D to mix with the atmosphere air from the air outlet passage 121D, and a liquid and air mixing passage 33D communicated with the air outlet passage 121D and the liquid outlet passage 4223D. The atmosphere air and the liquid soap 90D flow into the liquid and air mixing passage 33D and mix evenly therethrough. After the mixture of the atmosphere air and the liquid soap 90D is completely mixed, the mixture is delivered to and passed through the foam maker 321D to generate foam-type soap, and then the foam-type soap can be dispensed out the nozzle outlet 32D. In other words, the atmosphere air and the liquid soap 90D are pre-mixed through the liquid and air mixing passage 33D, and no mixing chamber is required to mix the atmosphere air and the liquid soap 90D.

On the other hands, the processing unit 34D is not only to adapted to store the passages, but also to support the automatic foam dispenser suspended inside the soap dispensing spout 30D, wherein a shaped and size of the processing unit is manufactured to fit into the soap dispensing spout 30D, and the processing unit 34D can be made of elastic materials having a restoring force. Especially, a cross sectional area of the processing unit 34D is slightly larger than that of the soap dispensing spout 30D, and the processing unit 34D is slightly deformed to fit into the soap dispensing spout 30D, and reinstates to its original shape and size for blocking and biasing against an inter wall surface of the soap dispensing spout 30D. Therefore, no additional accessories are required to hold the automatic foam dispenser inside the soap dispensing spout 30D.

Accordingly, the check valve 48D is embodied as a one-way valve which is adapted to allow the liquid soap flowing only towards one direction. Therefore, the liquid soap 90D flows only towards the liquid soap pump 42D, and cannot flow back to return to the liquid reservoir 44D.

The present invention further provides a foam soap dispenser pump system for synchronically pumping the atmosphere air and the liquid soap 90D inside the liquid reservoir 44D to the nozzle outlet 32D comprising the foam maker 321CD before the mixture of the atmosphere air and the liquid soap 90D is dispensed out. The liquid reservoir 44D is located below the liquid soap pump 42D, the air pump 120D, and the processing unit 34D, and the liquid soap 90D is upwardly pumped out from the liquid reservoir 44D to the upper-arranged liquid soap pump 42D, the air pump 120D, and the processing unit 34D to overcome the gravity of the liquid soap 90C.

The processing unit 34D comprises an air outlet passage 121D, a liquid inlet passage 4221D communicated with the liquid reservoir 44CD through a check valve 48C and a liquid outlet passage 4223D to deliver the liquid soap 90D to mix with the atmosphere air from the air outlet passage 121D, and a liquid and air mixing passage 33D communicated with the air outlet passage 121D and the liquid outlet passage 4223D. The atmosphere air and the liquid soap 90D flow into the liquid and air mixing passage 33D and mix evenly therethrough. The liquid soap pump 42D is driven to draw the liquid soap 90D out of the reservoir 44D, and pump out the liquid soap 90D to the liquid and air mixing passage 33D, and at the same time, the air pump 120D is driven to guide the atmosphere air into the liquid and air mixing passage 33D. In other words, the liquid soap pump 42D and the air pump 120D are adapted to provide a pulling pressure to force the liquid soap 90D and the atmosphere air evenly mixing through the liquid and air mixing passage 33D, and the pulling pressure is adapted to push the liquid soap 90D with the atmosphere air dissolved therein into the foam maker 32D, and then the foam soap formed by liquid soap 90D and the atmosphere air is injected out of the nozzle out 32D.

It is worth mentioning that the automatic foam dispenser can be cooperated with a sensor electrically connected with the liquid soap dispenser 40D and the air dispenser 100D, wherein the sensor is arranged on the soap dispensing spout 30D for detecting a presence of a user of the liquid soap user, and the liquid soap motor 20D and the air motor 110D are activated by the sensor for generating a rotational power to the first transmission shaft 4211A and the second transmission shaft 151A. Alternatively, the automatic foam dispenser also can be cooperated with a control valve for selectively activating the first and second transmission shaft 4211A, 151A, wherein the control valve can be a button, pull bar, faucet, or swivel arranged on the soap dispensing spout 30D.

After the mixture of the atmosphere air and the liquid soap 90D is completely mixed, the mixture is delivered to and passed through the foam maker 321D to generate foam-type soap, and then the foam-type soap can be dispensed out from the nozzle outlet 32D. In other words, the atmosphere air and the liquid soap 90D are pre-mixed through the liquid and air mixing passage 33D, and no mixing passage or chamber is required to mix the atmosphere air and the liquid soap 90D.

Accordingly, the check valve 48D is embodied as a one-way valve which is adapted to allow the liquid soap flowing only towards one direction. Therefore, the liquid soap 90D flows only towards the liquid soap pump 42D, and cannot flows back to return to the liquid reservoir 44D.

The foam maker 321D comprises two filters arranged on two ends of the foam makers 321D, wherein the pre-mixed liquid soap 90D and the atmosphere air is passed through the two filters respectively to form a foam-type soap, and the foam-type soap can be dispensed out of the nozzle outlet 32D.

It is worth mentioning that the liquid soap motor 20D and the air motor 110D are powered by a power source device through a power input wire, wherein the power source device can be rechargeable or disposable batteries, or a plug plugged into an external socket. Alternatively, the power source device can be a solar power charger in order to employ solar energy to supply electricity to the above mentioned two pumps.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatic foam soap dispenser for dispensing a liquid soap contained in a liquid reservoir in form of foam soap, comprising:

a mixing passage;

a liquid soap dispenser having a liquid soap pump communicated with said mixing passage for upwardly pumping the liquid soap to the mixing passage, and a power source associated with said liquid soap pump for driving said liquid soap pump, wherein said liquid reservoir is operatively coupled with said liquid soap pump and located below said liquid soap pump for storing the liquid soap;

an air dispenser having an air pump communicated with said mixing passage to synchronically and upwardly pump air into said mixing passage, wherein said power source is associated with said air pump for driving said air pump; and an outlet nozzle connected with said mixing passage and having at least a foam maker adapted for generating the foam soap, wherein said liquid soap dispenser and said air dispenser are located underneath said mixing passage, wherein said liquid soap pump comprises a first upper base having a liquid pump inlet communicated with said liquid reservoir, a liquid pump outlet communicated with said mixing passage, and a liquid transmission channel communicated with said liquid pump inlet and said liquid pump outlet.

2. The automatic foam soap dispenser, as recited in claim 1, wherein said liquid soap pump further comprises a first diaphragm comprising a first press chamber communicated with said liquid pump inlet and said liquid transmission channel, and a second press chamber communicated with said liquid pump outlet and said liquid transmission channel.

3. The automatic foam soap dispenser, as recited in claim 2, wherein said liquid soap pump further comprises a liquid soap motor and a first transmission shaft having one end associated with said liquid soap motor and another end associated with said first diaphragm to trigger a reciprocating motion for said first diaphragm.

4. The automatic foam soap dispenser, as recited in claim 3, wherein said liquid reservoir is adapted to contain the liquid soap which is arranged to be capable of delivering to said mixing passage which is arranged in an upper position to overcome a force of gravity acting upon the liquid soap.

5. The automatic foam soap dispenser, as recited in claim 4, wherein said air pump comprises a second upper base having an air pump outlet communicated with said mixing passage and at least one air pump inlet communicated with said air pump outlet through an air transmission channel, and a second diaphragm having one side comprising a third press chamber and a fourth press chamber communicated with said at least one air pump inlet respectively.

6. The automatic foam soap dispenser, as recited in claim 5, wherein said air pump further comprises an air motor and a second transmission shaft having one end associated with said air motor and another end operatively connected with another side of said second diaphragm to trigger a reciprocating motion of said second diaphragm.

7. The automatic foam soap dispenser, as recited in claim 6, wherein said air motor further comprises a motor base having a second extending portion operatively connected with said second transmission shaft, and defined a second receiving cavity for providing an operating space for said reciprocating motion.

8. The automatic foam soap dispenser, as recited in claim 7, wherein said air motor further comprises an air passage arranged throughout said motor base to deliver air into said third and fourth press chambers.

9. The automatic foam soap dispenser, as recited in claim 8, wherein the air inside said third and fourth press chambers are upwardly forced out through said at least one air pump inlet, said air transmission channel, and said air pump outlet sequentially for delivering the air to said mixing passage.

10. The automatic foam soap dispenser, as recited in claim 4, wherein said air pump comprises a second upper base having an air pump outlet communicated with said mixing passage and at least one air pump inlet communicated with said air pump outlet through an air transmission channel, and a second lower base having a second diaphragm having one side comprising a third press chamber and a fourth press chamber communicated with said at least one air pump inlet respectively.

11. The automatic foam soap dispenser, as recited in claim 10, wherein said air pump further comprises an air motor and a second transmission shaft having one end associated with said air motor and another end operatively connected with another side of said second diaphragm to trigger a reciprocating motion of said second diaphragm.

12. The automatic foam soap dispenser, as recited in claim 11, wherein said air motor further comprises a motor base and an air passage arranged throughout said motor base and said second lower base to deliver air into said third and fourth press chambers.

13. The automatic foam soap dispenser, as recited in claim 12, wherein the air inside said third and fourth press chambers are upwardly forced out through said air pump inlet, said air transmission channel, and said at least one air pump outlet sequentially for delivering the air to said mixing passage.

* * * * *